US010253595B2

(12) United States Patent
Difoggio

(10) Patent No.: US 10,253,595 B2
(45) Date of Patent: Apr. 9, 2019

(54) EVAPORATIVE COOLING USING A REFRIGERANT, A SELECTIVELY PERMEABLE MEMBRANE, AND A DRAWING FLUID

(71) Applicant: BAKER HUGHES INCORPORATED, Houston, TX (US)

(72) Inventor: Rocco Difoggio, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 40 days.

(21) Appl. No.: 15/291,820

(22) Filed: Oct. 12, 2016

(65) Prior Publication Data

US 2018/0100377 A1 Apr. 12, 2018

(51) Int. Cl.

| | |
|---|---|
| ***F25B 23/00*** | (2006.01) |
| ***E21B 36/00*** | (2006.01) |
| ***E21B 47/01*** | (2012.01) |

(52) U.S. Cl.

CPC ..... *E21B 36/001* (2013.01); *E21B 47/011* (2013.01); *F25B 23/006* (2013.01); *F25B 2400/17* (2013.01)

(58) Field of Classification Search

CPC ..... F25B 23/06; F25B 2400/17; F25B 23/00; F25B 23/006; F21B 36/00; F21B 36/001; F21B 47/011; Y02B 30/52; Y02E 10/12; Y02E 10/14; F24J 3/085; F24J 3/081

USPC ..... 62/259.2, 260, 475

See application file for complete search history.

(56) References Cited

U.S. PATENT DOCUMENTS

| | | | |
|---|---|---|---|
| 6,341,498 | B1 | 1/2002 | DiFoggio |
| 6,672,093 | B2 | 1/2004 | DiFoggio |
| 6,877,332 | B2 | 4/2005 | DiFoggio |
| 7,066,396 | B2 | 6/2006 | Knight et al. |
| 7,124,596 | B2 | 10/2006 | DiFoggio et al. |
| 7,540,165 | B2 | 6/2009 | DiFoggio et al. |
| 7,972,416 | B2 | 7/2011 | Wang et al. |

(Continued)

OTHER PUBLICATIONS

Uhlhorn, R.J. R., et al., "Gas transport and separation with ceramic membranes. Part I., Multilayer diffusion and capillary condensation," Twente University of Technology, Faculty of Chemical Engineering, Laboratory of Inorganic Chemistry, Material Science and Catalysis (Netherlands), Journal of Membrane Science, 66 (1992) 259-269.

(Continued)

*Primary Examiner* — Melvin Jones

(74) *Attorney, Agent, or Firm* — Mossman, Kumar & Tyler, PC

(57) ABSTRACT

An evaporative cooling apparatus may include a heat transfer module having a vapor passage in fluid communication with a liquid refrigerant in a first container and a heat absorbing module having a drawing liquid selected to absorb the liquid refrigerant in the second container. The heat absorbing module also has a vapor chamber in the drawing fluid that receives vapor generated during evaporation of the liquid refrigerant. The vapor chamber has a selectively permeable membrane that: (i) transports the vapor to the drawing liquid, and (ii) blocks flow of the drawing fluid into the vapor chamber. The refrigerant may be liquid water, the vapor chamber may include a selectively permeable membrane having a pore size between 1 nm and 200 nm, and the drawing fluid may be glycerol.

15 Claims, 3 Drawing Sheets

(56) References Cited

U.S. PATENT DOCUMENTS

| | | | | |
|---|---|---|---|---|
| 8,591,628 | B2 | 11/2013 | Wang et al. | |
| 9,322,551 | B2 | 4/2016 | Wang et al. | |
| 2003/0033829 | A1* | 2/2003 | Smith | A62B 9/003 62/480 |
| 2007/0193721 | A1* | 8/2007 | Tilton | F25B 43/04 165/104.19 |

OTHER PUBLICATIONS

Wang, D. et al, "Coal Power Plant Flue Gas Waste Heat and Water Recovery," Gas Technology Institute, Applied Energy 91 (2012) 314-348.

Drioli, E. et al., "ECTFE Membrane Preparation for Recovery of Humidified Gas Streams Using Membrane Condenser," Institute on Membrane Technology; Reactive & Functional Polymers 79 (2014) 1-7.

Macedonio, et al., "Membrane Condenser as a New Technology for Water Recovery from Humidified "Waste" Gaseous Streams," Institute on Membrane Technology (ITM-CNR), National Research Council, c/o The University of Calabria, Italy, Department of Chemical Engineering and Materials, The University of Calabria, Italy § WCU Energy Engineering Department, Hanyang University, Seongdong-gu, Seoul 133-791, South Korea.

Macedonio, et al., Water Recovery from Humidified Waste Gas Streams: Quality Control Using Membrane Condenser Technology; Institute on Membrane Technology (ITM-CNR), National Research Council, c/o The University of Calabria, Cubo 17C, Via Pietro Bucci, 87036 Rende CS, Italy, Chemical Engineering and Processing: Process Intensification.

Wang et al., "Transport membrane condenser for water and heat recovery from gaseous streams:Performance evaluation," State Key Laboratory of Materials—Oriented Chemical Engineering, Membrane Science and Technology Research Center, Nanjing Tech University, China, CSIRO Energy Technology, Australia,Journal of Membrane Science 484(2015)10-17.

* cited by examiner

| | Glycerin | Approx H2O | Glycerin | | | | | | | | | |
|---|---|---|---|---|---|---|---|---|---|---|---|---|
| | Conc in H2O Soln | Concen | Molarity | T | T | Osmotic P | R= 0.082057 L atm / (K mol) | | | | | |
| | g/L | g/cc | [mole/liter] | [C] | [K] | [psi] | R= 1.205901 L psi / (K mol) | | | | | |
| Pure Glycerin | 1260.90 | 0.00 | 13.69 | 100 | 373.15 | 6161 | | | | | | |
| 99% Glycerin | 1248.29 | 0.01 | 13.56 | 25 | 298.15 | 4874 | | | | | | |
| 99% Glycerin | 1248.29 | 0.01 | 13.56 | 100 | 373.15 | 6100 | Pure | ρ [g/liter] | ρ [g/cc] | MW [g/mole] | [mole/cc] | [mole/liter] |
| 99% Glycerin | 1248.29 | 0.01 | 13.56 | 150 | 423.15 | 6917 | Glycerol | 1260.9 | 1.2609 | 92.09 | 0.013692 | 13.69204 |
| 99% Glycerin | 1248.29 | 0.01 | 13.56 | 200 | 473.15 | 7734 | Water | 1000 | 1 | 18.01528 | 0.055508 | 55.50844 |
| 75% Glycerin | 945.68 | 0.25 | 10.27 | 25 | 298.15 | 3692 | | | | | | |
| 50% Glycerin | 630.45 | 0.50 | 6.85 | 25 | 298.15 | 2461 | | | | | | |
| 30% Glycerin | 378.27 | 0.70 | 4.11 | 25 | 298.15 | 1477 | | | | | | |
| 20% Glycerin | 252.18 | 0.80 | 2.74 | 25 | 298.15 | 985 | | | | | | |
| 10% Glycerin | 126.09 | 0.90 | 1.37 | 25 | 298.15 | 492 | | | | | | |
| 5% Glycerin | 63.05 | 0.95 | 0.68 | 25 | 298.15 | 246 | | | | | | |
| 1% Glycerin | 12.61 | 0.99 | 0.14 | 25 | 298.15 | 49 | | | | | | |

FIG. 3

EVAPORATIVE COOLING USING A REFRIGERANT, A SELECTIVELY PERMEABLE MEMBRANE, AND A DRAWING FLUID

BACKGROUND OF THE DISCLOSURE

1. Field of the Disclosure

The present disclosure is related to systems and related methods for evaporative cooling.

2. Background of the Art

The present disclosure is related to evaporative cooling. Of particular interest to us is evaporative cooling within a downhole tool. One way to cool a device downhole includes evaporating a refrigerant stored in the downhole tool from a liquid phase to a gaseous phase. The liquid phase is in thermal contact with the component to be cooled. As liquid evaporates, that component is cooled while, on the other side, the evaporated refrigerant carrying the heat, contacts a desiccant or other body that absorbs both the gas-phase refrigerant and the heat from a component in the downhole tool and then, eventually, transfers that heat to the wellbore fluid in which the downhole tool is immersed. Once the desiccant becomes saturated with refrigerant or the desiccant body's volume has been reached, the cooling ceases. Thus, the capacity of the desiccant to store refrigerant is one limiting factor in the overall effectiveness and utility of such an evaporative cooling system.

The present disclosure addresses the need for desiccants with improved capability to store refrigerant and reduced heat load to transfer to the heat sink, which can thereby enhance cooling operations in wellbore environments as well as other non-wellbore applications.

SUMMARY OF THE DISCLOSURE

In aspects, the present disclosure provides an evaporative cooling apparatus for cooling a region. The apparatus may include a heat transfer module and a heat absorbing module. The heat transfer module may include a first container, a liquid refrigerant in the first container, and a vapor passage in fluid communication with the first container. The heat absorbing module may include a second container, a drawing liquid in the second container and selected to absorb the liquid refrigerant, and a vapor chamber in the drawing fluid and configured to receive vapor generated during evaporation of the liquid refrigerant. The vapor chamber has a selectively permeable membrane configured to: (i) condense refrigerant vapor to a liquid, and (ii) block flow of the drawing fluid into the vapor chamber. In embodiments, the refrigerant may be liquid water, the vapor chamber may include a selectively permeable membrane having a pore size between 1 nm and 200 nm, and the drawing fluid may be glycerol.

In aspects, the present disclosure provides a method for cooling a region. The method may include positioning a heat transfer module in a region and positioning a heat absorbing module adjacent to the heat transfer module. The method may further include the steps of evaporating the liquid refrigerant in the first container to form a vapor; conveying the vapor to the vapor chamber; transporting the vapor through the selectively permeable membrane and into the drawing liquid; converting the transported vapor into a liquid; and storing the converted liquid in the drawing liquid.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein:

FIG. 3 shows the van 't Hoff equation calculations for osmotic pressure versus dilution of the glycerol-water drawing fluid.

DETAILED DESCRIPTION OF THE DISCLOSURE

Figure 1:
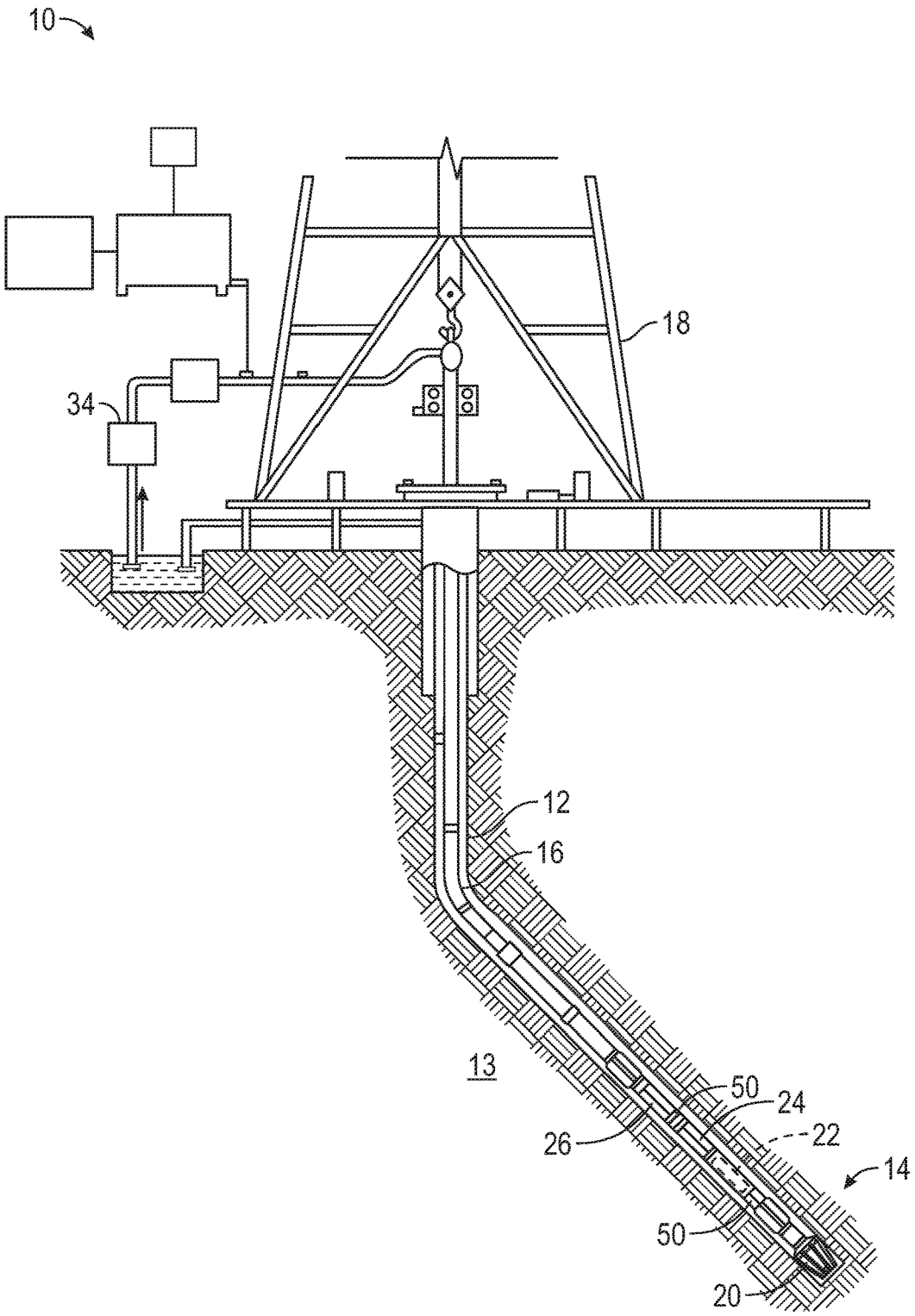
FIG. 1 is a schematic diagram of an exemplary drilling system for drilling a wellbore using a cooling apparatus according to the present disclosure.

Generally, the present teachings provide devices and related methods for evaporative cooling. In aspects, the present teachings provide devices and related methods for downhole evaporative cooling of electronics confined in a thermal flask. The electronics can include semiconductor light sources, sensors, processors, etc. To cool these electronics, some embodiments of the present disclosure use water as a cooling media and a supported, selectively permeable membrane for which one side is in contact with a hygroscopic drawing fluid such as glycerol which is chosen for its enormous affinity to water, its excellent stability at high borehole temperatures (a boiling point of 290 C), and its safe toxicity profile. The membrane is selectively permeable in that it allows water to flow through it but it does not glycerol to flow through it. Preferably, the membrane is a porous ceramic so that it is unaffected by high wellbore temperatures and its very small pore sizes are chosen both to allow steam to condense, despite the high temperatures, as well as to make it selectively permeable by means of molecular size exclusion. Such ceramic membranes are used to condense steam from the hot smokestacks of natural gas fired power plants in arid regions of the world to provide drinking water for the local populace.

During use, the heat transfer from the electronics to the liquid water generates steam. This steam exits the flask and contacts a receiving surface of the supported membrane. The membrane causes capillary condensation of the steam back to liquid and also absorbs most of the steam's heat. The drawing fluid, which contacts an expelling surface of the membrane draws this capillary-condensed liquid through the membrane. The drawing fluid absorbs the liquid water and also acts as a heat sink for this hot condensed liquid. The drawing fluid eventually dumps this heat to a suitable heat sink, such as the wellbore fluid. The teachings of the present disclosure may be advantageously applied to a variety of tools and systems used during all phases of well construction, completion, production, and workover. Merely for brevity, the present teachings are described below in the context of a drilling system.

Referring to FIG. 1, there is schematically illustrated a drilling system 10 for forming a wellbore 12 in an earthen formation 13. While a land-based rig is shown, these concepts and the methods are equally applicable to offshore drilling systems. Also, the wellbore 12 may include vertical sections, deviated sections, and horizontal sections, as well as branch wellbores. The drilling system 10 may use a bottomhole assembly (BHA) 14 conveyed by a rigid wellbore conveyance device such as a drill string 16 suspended from a rig 18. The drill string 16 may include a drill bit 20 at a distal end. The drill string 16 may be include any known drilling tubular adapted for use in a wellbore, e.g., jointed drill pipe, coiled tubing, casing, liner, etc.

The BHA 14 can also contain directional sensors and formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 13 surrounding the BHA 14. Such sensors are generally known in the art and for convenience are generally denoted herein by numeral 22.

The BHA 14 can further include a variety of other sensors and communication devices 24 for controlling and/or determining one or more functions and properties of the BHA (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. A suitable telemetry sub 26 using, for example, two-way telemetry, is also provided as illustrated in the BHA 14 and provides information from the various sensors and to the surface. These various electronic components can include the formation evaluation sensors 22, accelerometers, magnetometers, photomultiplier tubes, strain gauges, and other components which incorporate transistors, integrated circuits, resistors, capacitors, and inductors, for example. These electronic components can be exposed to temperatures in excess of 150° C. or 200° C., which can degrade performance or cause damage.

Figure 2:
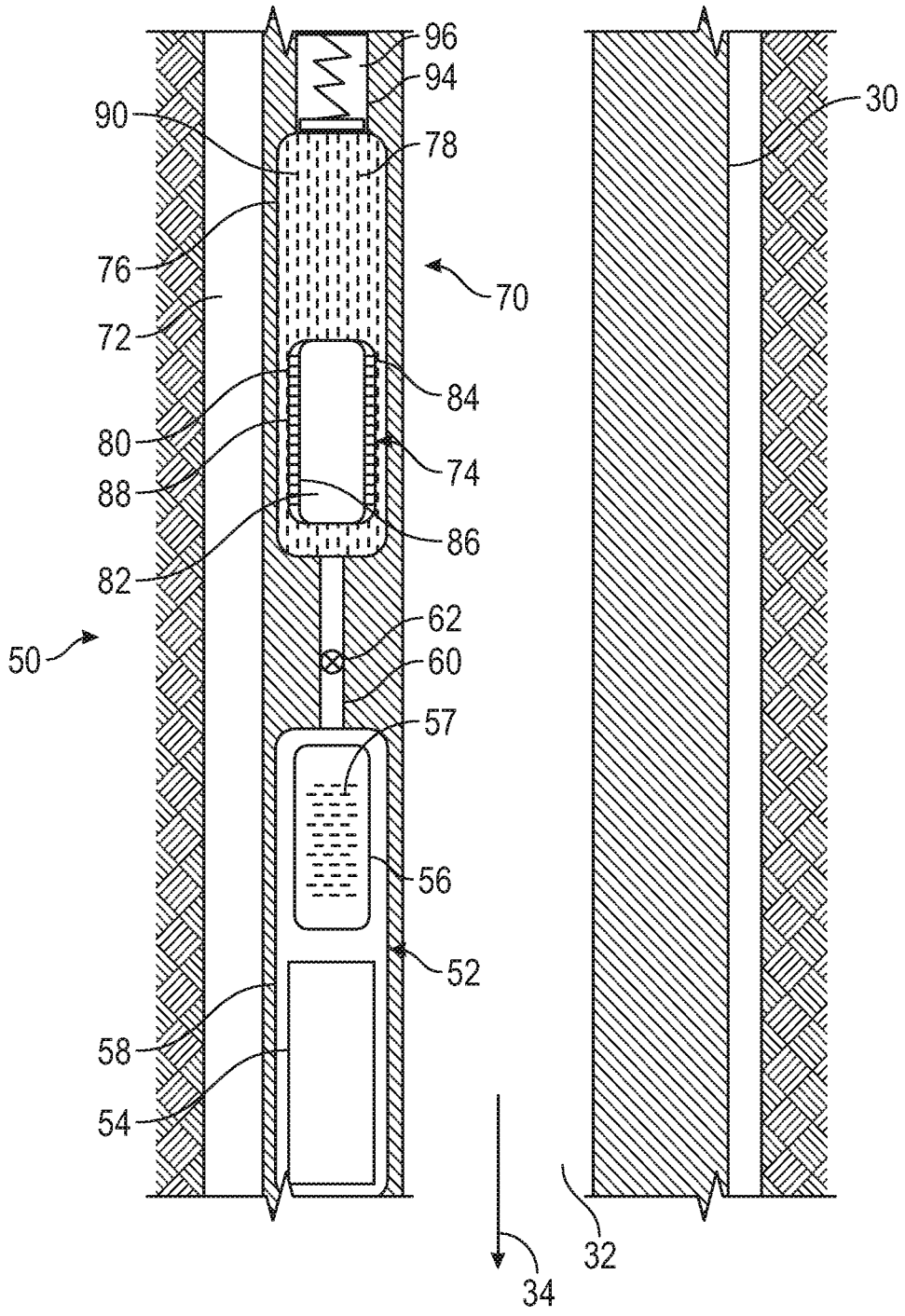
FIG. 2 shows an exemplary evaporative cooling apparatus in accordance with one embodiment of the present disclosure.

To cool such equipment, the bottomhole assembly 14 can include one or more cooling systems 50 that use evaporation of a liquid. Turning now to FIG. 2, there is schematically shown one embodiment of a cooling system 50 of the present disclosure for cooling heat-sensitive components such as electrical components associated with the BHA 14 (FIG. 1). These heat-sensitive components will be referred collectively as electronics 54. The cooling system 50 may include a heat transfer module 52 and a heat absorbing module 70. Generally, the cooling system 50 operates by transferring heat from the heat transfer module 52 to the heat absorbing module 70 by using a refrigerant. The heat absorbing module 70 absorbs the refrigerant and dumps the heat of the absorbed refrigerant to a heat sink.

For downhole applications, water is a desirable refrigerant for several reasons. First, water is an efficient coolant: evaporation of one liter of water removes 631.63 Watt-hours of energy. Evaporation of one liter of water can remove 632 Watts for one hour, 63 Watts for 10 hours, or 6.3 Watts for 100 hours. Water is also cheap, readily available worldwide, nontoxic, chemically stable, and poses no environmental disposal problems. Thus, for the discussion below, water is used as the illustrative cooling fluid, or 'refrigerant.'

The heat transfer module 52 provides a closed environment wherein heat from the electronics 54 is conducted to a body of water 57. In one arrangement, the heat transfer module 52 includes a liquid container 56 that contains the water 57, a Dewar flask 58, a vapor passage 60, and a control valve 62. The electronics 54 are positioned to enable unrestricted heat flow to the liquid container 56. The electronics 54 and liquid container 56 may be encased and surrounded by the insulating Dewar flask 58. The insulating Dewar flask 58 serves as thermal barrier to retard heat flow from surrounding areas into the electronics 54.

The vapor passage 60 runs through the Dewar flask 58 and forms a fluid pathway between the liquid container 56 and the heat absorbing module 70. During evaporation, the vapor from the liquid container 56 passes through the vapor passage 60 to the heat absorbing module 70. A control valve 62 controls the temperature of the liquid inside container 56 by controlling the evaporation rate of the water from the liquid container 56 by rapidly opening and closing to allow a short-duration pulse spray of steam as often as is needed. Any suitable component which controls the evaporation rate according to the required cooling power by temporarily retarding the flow of the vapor through the vapor passage 60 may be used. In one configuration, the control valve 62 limits the cooling rate of the electronics during a downhole run to avoid overcooling to an unnecessarily low temperature that would cause more rapid heat flow across Dewar walls and therefore waste water.

The heat absorbing module 70 absorbs the heat from the water vapor received from the heat transfer module 52 water and transfers this absorbed heat to a suitable heat sink, such as borehole fluid 72. In one illustrative embodiment, the heat absorbing module 70 may include a vapor chamber 74 positioned within a fluid container 76 that is filled with a drawing fluid 78.

The vapor chamber 74 is configured to allow diffusion of water vapor (or 'osmosis') but prevent diffusion of the drawing fluid 78. In one arrangement, the vapor chamber 74 may be formed as a tubular body 80 in which a cavity 82 receives water vapor from the control valve 62. The cavity 82 is defined by an inner surface 86 that contacts and receives the water vapor and an outer surface 88 that expels liquid water into the drawing fluid 78. The body 80 may be constructed to support a membrane 84 that provides the desired selective diffusion. As discussed previously, the membrane 84 may be a biological, synthetic, or polymeric membrane that is selectively permeable. By "selectively permeable," it is meant that the porosity of the membrane 84 is selected to let some molecules (such as water) or ions pass from either direction but block the passage of other molecules (such as glycerol) or ions regardless of direction. It should be understood that the term "selectively" is used to characterize the substance-specific behavior of the membrane as it relates to the diffusion of molecules/ions. Other terminology that describes such behavior may also be equally applicable when referring to a suitable membrane (e.g., semi-permeable, perm-selective membrane, etc.) One non-limiting suitable membrane 84 is a ceramic membrane formed of hydrophilic, mesoporous silica. In some embodiments, the pores are in the range of 1-5 nm because pores in this size range can cause capillary condensation of the steam back to liquid and also absorb some of the steam's heat.

The drawing fluid 78 absorbs the condensate that exits the membrane 84. The drawing fluid 78 should have a high affinity for the refrigerant being used. In one embodiment, a hygroscopic substance such as glycerol may be used as the drawing fluid 78 when the refrigerant is water. Because the membrane is selectively permeable, very high osmotic drawing pressures can be generated. FIG. 3 provides a chart of calculated osmotic pressures resulting from the interaction of the water and the glycerol.

Using the van 't Hoff equation, an initial osmotic pressure of 6161 psi for an undiluted, 100% glycerol (13.69 moles/liter) drawing fluid with water at 100 C is calculated as the product of the drawing fluid's glycerol molarity, the Kelvin temperature, and the universal gas constant, R=1.205901466 L psi/(K mole). The osmotic pressure is the pressure on the drawing fluid solution that would be required to force water in solution backwards through the selectively permeable membrane. An alternative way of envisioning osmotic pressure is by imagining a glass U-tube whose bottom cross section is blocked by a selectively permeable membrane. Above this membrane, there is initially a column of water on the left side of the U-tube and an equally high column of glycerol on the right side. Over time, the glycerol side will rise as it draws water in and the water side will fall as it loses water until equilibrium is reached and the pressure difference between the left and right fluid columns becomes equal to the osmotic pressure. Of course, as the drawing fluid becomes increasingly diluted with water, the osmotic pressure is correspondingly reduced. The van t' Hoff equation is first order in concentration and is only applicable for low concentrations of solute (water) in the glycerin-water drawing fluid solution. For higher solute (water) concentrations, a virial expansion equation for the osmotic pressure, Π, as shown below, should be used, which includes terms in the concentration, c, squared, c cubed, and so on, for which the van 't Hoff equation is the first term of this virial expansion. FIG. 3 only shows van 't Hoff equation calculations, even for high concentrations of water in glycerin, because the second order fitting coefficient, B, for a glycerin-water system was not found in the literature.

$$\Pi=(RT/M)c+Bc^2+\ldots$$

It should be appreciated that the use of a selectively permeable membrane capitalizes on these generated osmotic pressures to draw condensed water vapors from the vapor chamber 74.

Glycerol has a number of favorable properties that make it desirable as a drawing fluid. First, a particularly favorable property of glycerol is that a given volume of glycerol can easily store one hundred percent or more of that same given volume of water. In principle, glycerol can store many times its own volume of water but with correspondingly lower osmotic drawing pressure so it may not be as effective at drawing additional water when the drawing solution is already mostly water. This is in marked contrast to a desiccant such as zeolite, which requires up to six times the amount of volume of the water to be absorbed. We can understand this because only the pores of the zeolite can absorb water and they may be only 25% of the volume of each zeolite bead. Furthermore, the voids between the zeolite beads will not store water but these spaces between beads are needed so that the water vapor can gain access to the surface of each bead. Therefore, with zeolite, no more than approximately ⅙ of the space reserved for desiccant is available to store water. By going to a liquid desiccant, 100% of the space reserved for desiccant is available to store water. This fact is particularly important for while-drilling systems where the only place for a desiccant chamber is the very limited annular volume within the drill collar. Thus, the fluid container 76 can be dramatically reduced in size vis-à-vis a zeolite-based cooling system.

Another favorable property is that glycerol is a relatively benign substance and its non-toxicity is widely recognized and it has a very high boiling point of 290 C so it is stable at borehole temperatures. Accordingly, as compared to other desiccants, glycerol does not impose any heightened precautions during shipment, handling, or during actual use. Still another favorable property of glycerol is the relatively muted magnitude of the exothermic reaction when interacting with water. The maximum temperature rise due to the heat of mixing of water with glycerol occurs at 58% by weight glycerol and results in only a five degree Celsius temperature increase of the mixture whereas the interaction between an equal volume of water and zeolite has been reported to bring water to near boiling. Water sorption heating occurs in zeolite because the reaction of zeolite with water is very exothermic so that 1.8 calories of heat are released into the zeolite for every calorie of heat that was removed from the liquid water by evaporation, which then adds significantly to the heat load that needs to be dumped to the heat sink. Moreover, because pore sizes as large as 200 nm can block over ninety nine percent of glycerol diffusion, a membrane having a 1-5 nm pore size can effectively prevent glycerol from diffusing through the membrane to vapor chamber 74. By contrast, water can go through pores as small as 0.3 nm.

The fluid container 76 provides a closed environment in which the water can be absorbed by the drawing fluid 78. In one arrangement, the fluid container 76 has an inner volume 90 for receiving the drawing fluid 78. The vapor chamber 74 is also in the volume 90 and immersed in the drawing fluid 78. The container 76 may be shaped as required to fit within a section of the BHA 14 and positioned to transport heat to a suitable heat sink, such as the borehole fluid 72 in the annulus surrounding the BHA 14.

In some embodiments, the fluid container 76 may be configured to have a variable volume. As the drawing fluid 78 absorbs liquid water, the volume of the drawing fluid 78 will necessarily increase in size. Therefore, an expansion chamber 94 may be used to increase the available volume for accommodating the absorbed fluid. In some arrangements, a pressure assembly 96, which may include a biasing member, such as a spring, and a movable piston, may be used to maintain a pressure on the drawing fluid 78 to ensure that the vapor chamber 74 is always fully submerged in the drawing fluid 78.

As noted earlier, the heat absorbing module 70 transfers the absorbed heat to a suitable heat sink, such as the fluid 72 in the annulus surrounding the section 30 of the drill string. To facilitate this heat transfer, heat conducting elements (not shown), such as rods, vanes, or fins, made of suitable materials such as aluminum or copper, which have much higher thermal conductivity than the drawing fluid itself, may be positioned inside the fluid container 76. These heat conductors can be used to transfer heat from the vapor chamber 74 and the drawing fluid 78 to the borehole fluid 72.

In FIG. 2, the cooling system 50 is schematically illustrated as positioned in the annular section 30 of the drill string 16 (FIG. 1). It should be noted that the space available for equipment is restricted by the presence of the bore 32 through which drilling fluid 34 flows between the surface and the drill bit 20 (FIG. 1). Favorably, as compared to zeolite based cooling systems, the cooling system 50 consumes less of the available space because the storage volume of glycerol is far less than the storage volume of zeolite (e.g., twice the volume of water versus six times the volume of water). It should be further noted that only the evaporation-rate control valve 62 may require a power source, such as electrical power, in order to operate. The remainder of the cooling system 50 does not require any external power source in order to operate. The thermal gradients created by operating this cooling system could be tapped by a thermoelectric generator to provide the small amount of power needed for the control valve.

It should be understood that the teachings of the present disclosure are susceptible to numerous variants. For example, alternatives to ceramic membranes include polymeric membranes such as polybenzimidazole (trade name CELAZOLE, continuous service to 316 C, which is 600 F, melting point 399 C, which is 750 F) or Ethylene-Chlorotrifluoroethylene copolymer (ECTFE) (melting point 234 C to 242 C). Alternative drawing fluids include other polyols such as propylene glycol and butylene glycol, or liquid hydroxyl amines, such as monoethanol amine and diethanol amine, or concentrated salt solutions such as lithium chloride or lithium bromide. Refrigerants other than water include methanol, ethanol, ammonia, or other compounds. It should be noted that glycerol and glycerin are different names for the same chemical.

Further, although the cooling systems disclosed above are discussed with respect to the exemplary drilling system 10 of FIG. 1, alternate embodiments wherein the cooling system is incorporated into a tool conveyed by a non-rigid conveyance device such as a wireline, slickline, e-line, or coiled tubing, is also considered within the scope of the present disclosure.

It is again emphasized that the benefits of the present teachings may be realized in a variety of industrial, commercial, residential, or other settings wherein a region may need cooling. For example, systems that currently employ a zeolite desiccant based cooling apparatus may instead use a liquid based cooling arrangement of the present teachings. Moreover, because the present cooling arrangements are environmentally-safe and amenable to compact designs, they may be used in aircrafts, watercrafts, submersibles, etc. to cool equipment such as instruments, sensors, and microprocessors.

While the foregoing disclosure is directed to the one mode embodiments of the disclosure, various modifications will be apparent to those skilled in the art. It is intended that all variations within the scope of the appended claims be embraced by the foregoing disclosure.

I claim:

1. An evaporative cooling apparatus for cooling a region, comprising:

a heat transfer module associated with the region and including:
- a first container,
- a liquid refrigerant in the first container,
- a vapor passage in fluid communication with the first container; and a heat absorbing module adjacent to the heat transfer module, the heat absorbing module including:
- a second container,
- a drawing liquid in the second container, the drawing liquid selected to absorb the liquid refrigerant, and
- a vapor chamber in the drawing liquid and configured to receive vapor generated during evaporation of the liquid refrigerant, the vapor chamber having a selectively permeable membrane configured to: (i) condense refrigerant vapor to a liquid, and (ii) block flow of the drawing liquid into the vapor chamber.

2. The apparatus of claim 1, wherein the selectively permeable membrane condenses the vapor to a liquid stage.

3. The apparatus of claim 1, wherein the selectively permeable membrane has a pore size no larger than 200 nm.

4. The apparatus of claim 3, wherein the selectively permeable membrane has a pore size at least 1 nm.

5. The apparatus of claim 1, wherein the selectively permeable membrane is formed at least of ceramic formed of hydrophilic, mesoporous silica.

6. The apparatus of claim 1, wherein the liquid refrigerant is water.

7. The apparatus of claim 1, wherein the drawing liquid is glycerol.

8. The apparatus of claim 1, further comprising:

a conveyance device configured to be disposed in a wellbore, the conveyance device including at least one heat-sensitive component, wherein the heat transfer module is in thermal communication with the at least one heat-sensitive component.

9. The apparatus of claim 8, wherein the conveyance device is a drill string configured to drill the wellbore, the heat transfer module and the heat absorbing module being disposed in a section of the drill string.

10. An evaporative cooling apparatus for cooling a region comprising:

a heat transfer module associated with a downhole tool and including:
- a first container,
- a body of liquid water in the first container, and
- a vapor passage in fluid communication with the first container; and a heat absorbing module adjacent to the heat transfer module, the heat absorbing module including:
- a second container,
- a body of glycerol in the second container, and
- a vapor chamber in the glycerol and configured to receive vapor generated during evaporation of the body of liquid water, the vapor chamber including a selectively permeable membrane having a pore size between 1 nm and 200 nm.

11. A method for cooling a region comprising:

positioning a heat transfer module in a region, the heat transfer module including:
- a first container,
- a liquid refrigerant in the first container,
- a vapor passage in fluid communication with the first container; and positioning a heat absorbing module adjacent to the heat transfer module, the heat absorbing module including:
- a second container,
- a drawing liquid in the second container, and
- a vapor chamber in the drawing liquid and configured to receive vapor generated during evaporation of the liquid refrigerant, the vapor chamber having a selectively permeable membrane configured to: (i) condense refrigerant vapor to a liquid, and (iii) block flow of the drawing liquid into the vapor chamber;

evaporating the liquid refrigerant in the first container to form a vapor;

conveying the vapor to the vapor chamber;

transporting the vapor through the selectively permeable membrane and into the drawing liquid;

converting the transported vapor into a liquid; and storing the converted liquid in the drawing liquid.

12. The method of claim 11, wherein the selectively permeable membrane is formed at least of ceramic formed of hydrophilic silica having a pore size at least 1 nm and no larger than 200 nm.

13. The method of claim 11, wherein the vapor is transported through the selectively permeable membrane using capillary action, and wherein the liquid refrigerant is water and the drawing liquid is glycerol.

14. The method of claim 11, further comprising removing heat from the vapor being transported through the selectively permeable membrane.

15. The method of claim 11, further comprising conveying the heat transfer module and the heat absorbing module along a wellbore using a conveyance device.

* * * * *